US008616278B2

(12) United States Patent
Boone et al.

(10) Patent No.: US 8,616,278 B2
(45) Date of Patent: Dec. 31, 2013

(54) CREATION OF A HYDRATE BARRIER DURING IN SITU HYDROCARBON RECOVERY

(75) Inventors: Thomas J. Boone, Calgary (CA); Mori Y. Kwan, Calgary (CA)

(73) Assignee: ExxonMobil Upstream Research Company, Houston, TX (US)

( * ) Notice: Subject to any disclaimer, the term of this patent is extended or adjusted under 35 U.S.C. 154(b) by 417 days.

(21) Appl. No.: 13/099,041

(22) Filed: May 2, 2011

(65) Prior Publication Data

US 2011/0290488 A1 Dec. 1, 2011

(30) Foreign Application Priority Data

May 27, 2010 (CA) ..... 2705680

(51) Int. Cl.
*E21B 33/13* (2006.01)
*E21B 43/22* (2006.01)
*E21B 43/24* (2006.01)

(52) U.S. Cl.
USPC ..... 166/270; 166/268; 166/272.5; 166/272.7; 166/288; 166/303; 166/305.1

(58) Field of Classification Search
None
See application file for complete search history.

(56) References Cited

U.S. PATENT DOCUMENTS

| | | | | |
|---|---|---|---|---|
| 3,559,737 | A | 2/1971 | Ralstin et al. | 166/281 |
| 4,280,559 | A | 7/1981 | Best | 166/303 |
| 4,344,485 | A | 8/1982 | Butler | 166/271 |
| 5,899,274 | A | 5/1999 | Frauenfeld et al. | 166/401 |
| 6,028,234 | A | 2/2000 | Heinemann et al. | 585/15 |
| 6,662,872 | B2 | 12/2003 | Gutek et al. | 166/272.4 |
| 6,708,759 | B2 | 3/2004 | Leaute et al. | 166/272.4 |
| 2003/0015321 | A1* | 1/2003 | Lim et al. | 166/263 |
| 2004/0200618 | A1* | 10/2004 | Piekenbrock | 166/305.1 |
| 2008/0221799 | A1 | 9/2008 | Murray | 702/11 |
| 2008/0257544 | A1 | 10/2008 | Thigpen et al. | 166/250.01 |
| 2008/0262737 | A1 | 10/2008 | Thigpen et al. | 702/9 |
| 2009/0032248 | A1 | 2/2009 | Svoboda et al. | 166/249 |
| 2010/0012331 | A1* | 1/2010 | Larter et al. | 166/401 |

FOREIGN PATENT DOCUMENTS

CA 1246993 12/1988

(Continued)

OTHER PUBLICATIONS

Aggarwal et al.; SOLMNEQF (1986) "A Computer Code for Geochemical Modeling of Water-Rock Interactions in Sedimentary Basins," *Third Canadian/American Conference in Hydrogeology*, pp. 196-203.

(Continued)

*Primary Examiner* — George Suchfield
(74) *Attorney, Agent, or Firm* — ExxonMobil Upstream Research Company-Law Department

(57) ABSTRACT

Certain viscous oil reservoirs are too deep to be commercially mined but lack an adequate top seal to employ in situ recovery methods such as SAGD. Without an adequate top seal, gases from the reservoir can rise into overlying aquifers and potentially to the surface. While ice-like hydrates would not normally form above the oil reservoir during in situ recovery, an additive can be added to promote hydrate formation. In this way, a hydrate barrier can be formed to act as a top seal to contain these gases.

19 Claims, 2 Drawing Sheets

(56) References Cited

FOREIGN PATENT DOCUMENTS

| | | |
|---|---|---|
| CA | 2038290 | 4/1994 |
| CA | 2349234 | 12/2004 |
| CA | 2288784 | 7/2007 |
| CA | 2672487 | 6/2008 |
| CA | 2293686 | 7/2008 |
| GB | 2377718 | 1/2003 |

OTHER PUBLICATIONS

Katz et al. (1959) *Handbook of Natural Gas Engineering*, McGraw-Hill Bk. Co., p. 212.

Peng et al. 1976) "A New Two-Constant Equation of State," *Ind. Eng. Chem.*, vol. 15.1, p. 59-64.

* cited by examiner

CREATION OF A HYDRATE BARRIER DURING IN SITU HYDROCARBON RECOVERY

CROSS-REFERENCE TO RELATED APPLICATIONS

This application claims priority from Canadian patent application number 2,705,680 filed on May 27, 2010 entitled Creation of a Hydrate Barrier During In Situ Hydrocarbon Recovery, the entirety of which is incorporated by reference herein.

FIELD OF THE INVENTION

The present invention relates generally to the recovery of in situ hydrocarbons from a subterranean reservoir.

BACKGROUND OF THE INVENTION

Viscous oil, such as heavy oil or bitumen, residing in reservoirs that are sufficiently close to the surface may be mined.

Viscous oil residing in reservoirs that are too deep for commercial mining may be recovered by in situ processes. Commonly, viscous oil is produced from subterranean reservoirs using in situ recovery processes that reduce the viscosity of the oil enabling it to flow to the wells; otherwise, an economic production rate would not be possible. In commercial in situ viscous oil recovery processes, the temperature or pressure is modified or a solvent is added to reduce the viscosity or otherwise enhance the flow of the viscous oil within the reservoir. Such a solvent is referred to herein as a "viscosity reducing solvent" or simply a "solvent".

Various in situ processes for recovering viscous oil are known including CSS (Cyclic Steam Stimulation), CSD (Constant Steam Drainage), SAGD (Steam Assisted Gravity Drainage), SA-SAGD (Solvent Assisted-Steam Assisted Gravity Drainage), VAPEX (Vapor Extraction), CSDRP (Cyclic Solvent-Dominated Recovery Process), LASER (Liquid Addition to Steam for Enhancing Recovery), SAVEX (Combined Steam and Vapor Extraction Process), water flooding, and steam flooding.

An example of CSS is described in U.S. Pat. No. 4,280,559 (Best). An example SAGD is described in U.S. Pat. No. 4,344,485 (Butler). An example of SA-SAGD is described in Canadian Patent No. 1,246,993 (Vogel). An example of VAPEX is described in U.S. Pat. No. 5,899,274 (Frauenfeld). An example of CSDRP is described in Canadian Patent No. 2,349,234 (Lim). An example of LASER is described in U.S. Pat. No. 6,708,759 (Leaute et al.). An example of SAVEX is described in U.S. Pat. No. 6,662,872 (Gutek).

In certain processes, such as in SAGD (Steam Assisted Gravity Drainage), a dedicated injection well and a dedicated production well are used.

In other processes, such as in CSS (Cyclic Steam Stimulation), the same well is used both for injecting a fluid and for producing oil. In CSS, cycles of steam injection, soak, and oil production are employed. Once the production rate falls to a given level, the well is put through another cycle of injection, soak, and production.

Certain viscous oil reservoirs are too deep to be commercially mined but lack an adequate top seal to employ in situ recovery methods using a fluid injectant (e.g. SAGD, SA-SAGD, and VAPEX) due to the potential loss of the injectant (for example steam or a solvent), or other gases, from the reservoir upwardly and, for instance, into an aquifer or to the surface. Significant deposits in the Athabasca oil sands region of Alberta, Canada, possess these characteristics.

Therefore, one limitation of solvent, steam, and solvent-steam combination in situ viscous oil recovery methods is the requirement for an adequate top seal. Reservoirs at this relatively shallow depth and lacking an adequate top seal are often silty sands or shales that may not adequately contain gases within the reservoir.

It would be desirable to have a method of recovering in situ viscous oil residing in reservoirs lacking an adequate top seal.

SUMMARY OF THE INVENTION

According to an aspect of the instant invention, there is provided a method of recovering in situ hydrocarbons lacking an adequate top seal to contain non-condensable gases. Most usefully, the method is used to recover viscous oil that is too deep to be commercially mined. Without an adequate top seal, non-condensable gases generated during in situ recovery would rise out of the reservoir and potentially to an aquifer or to the surface. It is taught herein that a hydrate promoting additive can be introduced, into or above, the reservoir, to mix with the generated non-condensable gases. This additive lowers the thermodynamic threshold for hydrates to form so that the mixture of water and non-condensable gases above the reservoir can form a hydrate barrier that would not otherwise form. This hydrate barrier limits further rise of non-condensable gases. In a convenient embodiment, the additive is co-injected with the viscosity reducing injectant, for example steam in a SAGD process.

According to another aspect of the instant invention, there is provided a method of forming a hydrate barrier during in situ hydrocarbon production above a reservoir of the hydrocarbons, the method comprising: selecting a hydrate promoting additive; and introducing the additive into, or above, the reservoir for mixing with generated non-condensable gases, to promote hydrate formation in an area above the reservoir, for forming the hydrate barrier in the area, for limiting passage of non-condensable gases therethrough; wherein the hydrate barrier comprises hydrates comprising water and non-condensable gases.

In certain embodiments, the following features may be present. The hydrocarbons may be a viscous oil having a viscosity of at least 10 cP at initial reservoir conditions. The additive may be introduced into the reservoir. The additive may comprise methane, ethane, propane, or a combination thereof. The additive may comprise ethane, propane, or a combination thereof. The in situ hydrocarbon production may be by injection of a viscosity reducing solvent and production of the viscosity reducing solvent and the hydrocarbons. The in situ hydrocarbon production may be by SA-SAGD, SAGD, or VAPEX. The additive may be co-injected with steam, the steam being for reducing the viscosity of the in situ hydrocarbons. The additive may be co-injected with a viscosity reducing solvent, the viscosity reducing solvent being for reducing the viscosity of the in situ hydrocarbons. The viscosity reducing solvent may comprise a $C_{5+}$ gas condensate comprising pentane and hexane. The non-condensable gases may comprise hydrocarbon vapour. The hydrate barrier may comprise the hydrates and naturally occurring consolidated or unconsolidated material. The additive may itself be one that is capable of forming hydrates with water. The reservoir may be a reservoir lacking an adequate top barrier to contain non-condensable gases. The reservoir may be at a depth of between 100 m and 250 m. A sufficient amount of the additive may be introduced into, or above, the reservoir to allow hydrate formation in the area above the reservoir in which the hydrate barrier forms at between 4° C. and 12° C. The area above the reservoir in which the hydrate barrier forms may be an aquitard. The method may further comprise, prior to injecting the additive, estimating relative fractions of the non-condensable gases that will be generated during the in situ hydrocarbon production selected; and using the estimated relative fractions to select the additive.

Other aspects and features of the present invention will become apparent to those ordinarily skilled in the art upon review of the following description of specific embodiments of the invention in conjunction with the accompanying Figures.

BRIEF DESCRIPTION OF THE DRAWINGS

Embodiments of the present invention will now be described, by way of example only, with reference to the attached Figures, wherein.

DETAILED DESCRIPTION

Definitions

Figure 1:
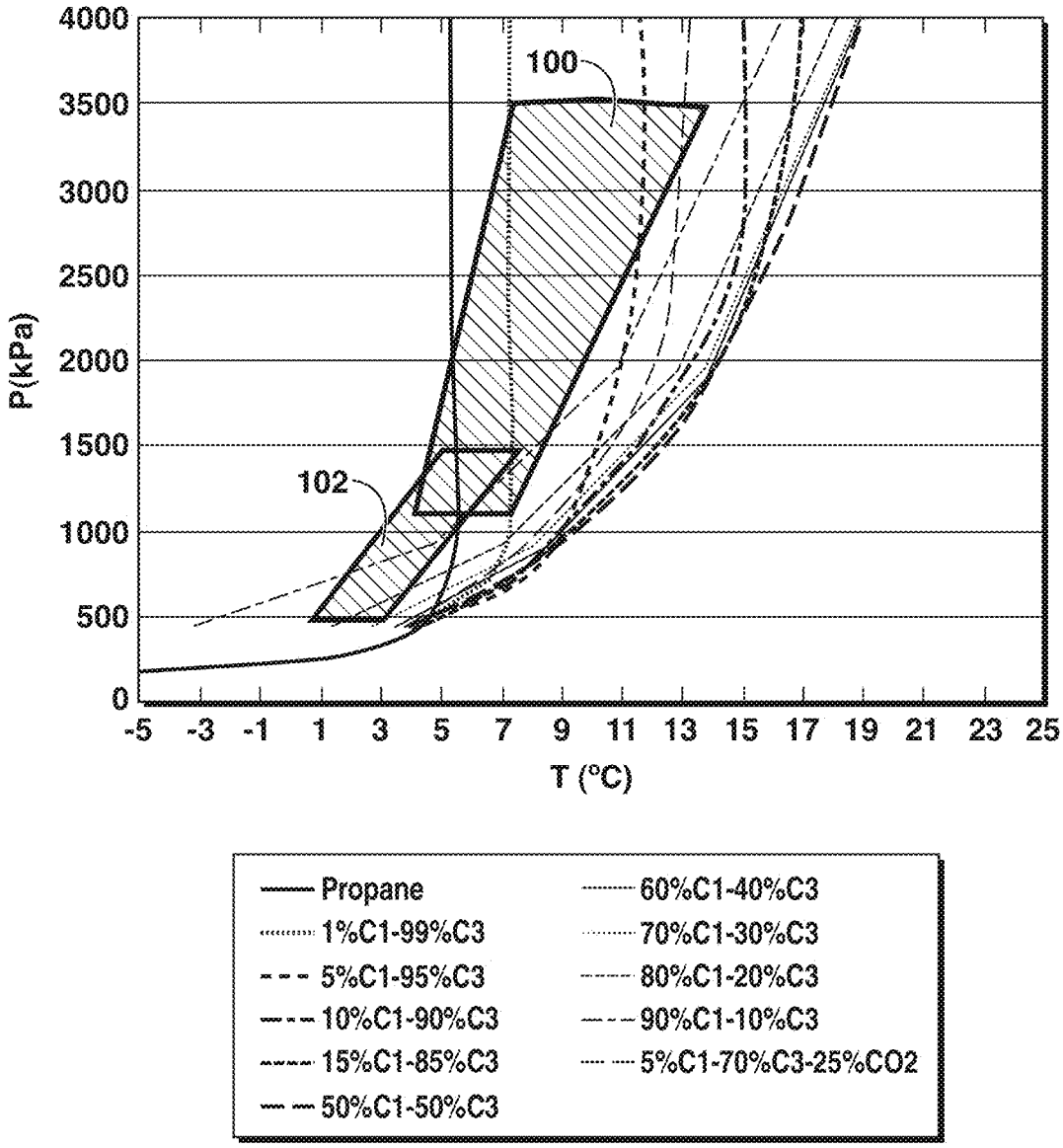
FIG. 1 is a graph showing gas hydrate formation equilibrium curves for various compositions.

The term "viscous oil" as used herein means a hydrocarbon, or mixture of hydrocarbons, that occurs naturally and that has a viscosity of at least 10 cP (centipoise) at initial reservoir conditions. Viscous oil includes oils generally defined as "heavy oil" or "bitumen". Bitumen is classified as an extra heavy oil, with an API gravity of about 10° or less, referring to its gravity as measured in degrees on the American Petroleum Institute (API) Scale. Heavy oil has an API gravity in the range of about 22.3° to about 10°. The terms viscous oil, heavy oil, and bitumen are used interchangeably herein since they may be extracted using similar processes.

In situ is a Latin phrase for "in the place" and, in the context of hydrocarbon recovery, refers generally to a subsurface hydrocarbon-bearing reservoir. For example, in situ temperature means the temperature within the reservoir. In another usage, an in situ oil recovery technique is one that recovers oil from a reservoir within the earth.

The term "formation" as used herein refers to a subterranean body of rock that is distinct and continuous. The terms "reservoir" and "formation" may be used interchangeably.

The term "hydrate barrier" as used herein refers to a layer including hydrates that limits, but does not necessarily completely prevent, non-condensable gases from passing therethrough. In other words, the hydrate barrier reduces the permeability of the area in which it forms.

The term "non-condensable gases" as used herein refers to gases that do not typically condense during the in situ recovery process in the reservoir or in the overburden.

The term "hydrate promoting additive" is an additive that lowers the thermodynamic threshold for hydrates to form so that the mixture of water and non-condensable gases above the reservoir can form a hydrate barrier that would not otherwise form.

One known method of producing viscous oil from reservoirs that are too deep to be commercially mined and that lack an adequate top seal is to use low pressure processes (for example low pressure SAGD). If the process is operated at a pressure just below the pressure of an aquifer disposed above the reservoir plus the hydrostatic gradient, then the potential difference between the aquifer and viscous oil reservoir will be such that water from the overlying aquifer will tend to flow downward at a very slow rate. This will prevent any contamination of the aquifer by reservoir fluids such as water or oil. However, a problem with this approach is that gases from the reservoir will tend to rise due to buoyancy. The major components of the gas phase are typically steam, methane, $CO_2$, and $H_2S$. The steam will tend to condense as it rises into the cooler overburden and drain down as liquid water. However, the remaining non-condensable gases will continue to rise due to buoyancy. The non-condensable gases are generally known to come from three different sources: methane is dissolved in the viscous oil, $CO_2$ is primarily generated from heating the rock (in thermal processes), and $H_2S$ is generated from water-viscous oil reactions at high temperature (in thermal processes).

Hydrates

Hydrates, also referred to as "gas hydrates" or "gas clathrates", are somewhat similar to water ice and comprise solid-phase water in which one of several lattice structures act as the molecular cages to trap the 'guest' molecules. Hydrates can be formed with many 'guest' molecules, including methane, ethane, propane, butane, and carbon dioxide. The conditions at which hydrates will form depend on many factors including temperature, pressure, and composition. Hydrates are well known to be stable over a wide range of high pressures (generally at least several atmospheres) and near ambient temperatures (as described, for instance, in Katz et al.; *Handbook of Natural Gas Engineering*; McGraw-Hill Bk. Co., p. 212; 1959). Specific hydrate formation conditions are composition dependent. For example, methane forms solid hydrates with pure water at temperatures above 0° C. at pressures greater than about 2.5 MPa, whereas propane forms solid hydrates with pure water at temperatures of about 0° C. at pressures greater than about 0.16 MPa.

Importantly, hydrates can form at temperatures up to 15° C. or greater so that they can be formed below the ground surface in rocks comprising mixtures of gas and water, including the rocks overlying locations where thermal recovery methods are employed.

Hydrates may be either naturally occurring or man-made. Man-made hydrates are commonly created during oil and gas production and processing when the phase boundary of hydrates is unintentionally encroached.

Man-made hydrates are often perceived as a problem due to their tendency to plug pipes and equipment. Normally, if hydrates are inadvertently formed in situ during oil and gas recovery, production can be significantly reduced. This may be a particular issue if low molecular weight solvents (for example ethane, propane, or carbon dioxide) are injected into relatively cold oil-bearing reservoirs to assist production.

Typically gases are very mobile fluids when found in porous, permeable rock. However, if the conditions are such that the gases convert to a hydrate or a solid state, the gas molecules will no longer be mobile and will be confined to the porous rock.

Hydrate Barrier

It is taught herein that a hydrate promoting additive can be introduced, into or above, the reservoir, to mix with the generated non-condensable gases. This additive lowers the thermodynamic threshold for hydrates to form so that the mixture of water and non-condensable gases above the reservoir can form a hydrate barrier that would not otherwise form. This hydrate barrier limits further rise of non-condensable gases. In a convenient embodiment, the additive is co-injected with the viscosity reducing injectant, for example steam in a SAGD process.

The formations overlying certain oil sands (for example in Alberta, Canada) are at relatively cool temperatures, that is, typically about 2 to 4° C. near the surface and increasing with depth at a gradient of about 20 to 25° C. per kilometer. Aquitards overlying certain oil sands are commonly at temperatures between 4 and 8° C. Water will not form ice at these temperatures and at the pressures found in this area. However, water in the presence of certain light hydrocarbon vapours (for example $C_1$ to $C_3$) and other non-condensable gases (for example $H_2S$, $CO_2$, and $N_2$) will form ice-like hydrates at these temperatures. Minor amounts of these non-condensable gases mixed with the light hydrocarbon vapours can raise the hydrate formation temperature into the 4 to 8° C. window, so that hydrates will form.

To promote hydrate formation above the reservoir, other hydrocarbon gases may be added into, or above, the reservoir. For example, if propane is added to the mixture, hydrates can form in the range of 6 to 12° C. FIG. 1 is a graph showing gas hydrate formation equilibrium curves for various compositions. As illustrated in FIG. 1, the addition of propane to a $C_1$—$CO_2$ system can expand the range of hydrate formation conditions to encompass most Alberta oil sand conditions (100) and aquitard or aquifer conditions (102) at their native pressure and temperature. If the rising non-condensable gases combine with the native water to form hydrates, these hydrates will act as a barrier limiting the rise of the gases. Additionally, the solid hydrates will plug the pores of the overburden and significantly reduce the permeability of the overburden to gas. As a result, an effective barrier to flow may develop which may contain the reservoir recovery process.

Figure 2:
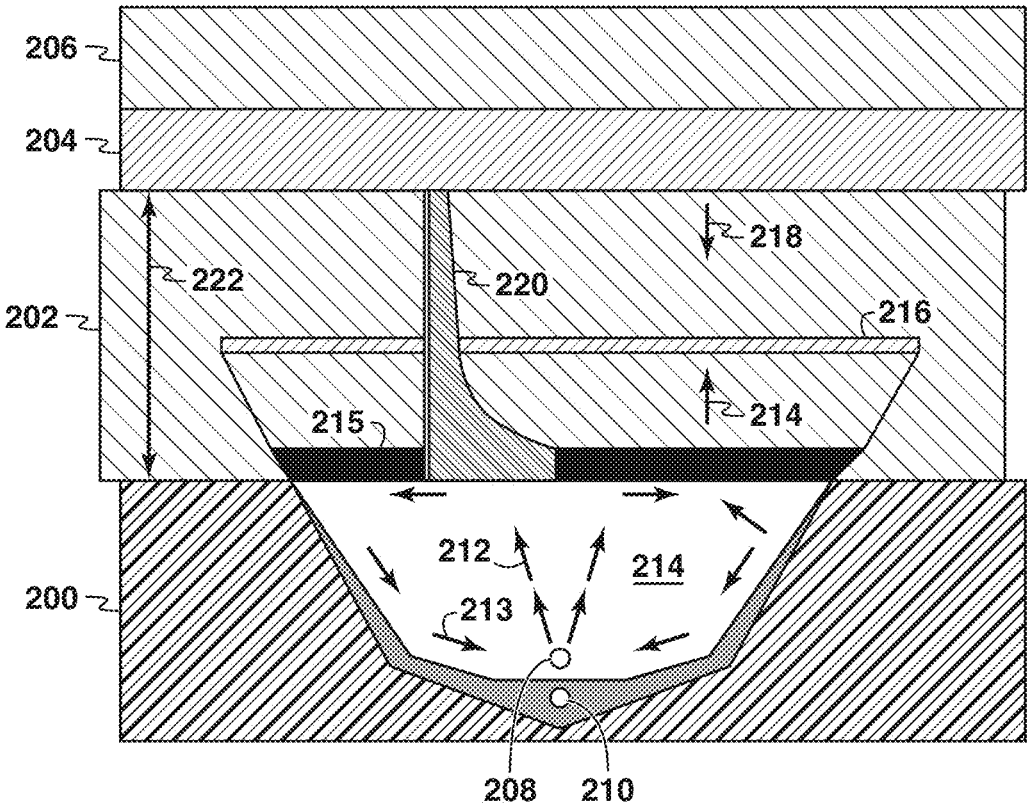
FIG. 2 is a schematic of a subterranean area including an oil sand reservoir, undergoing a recovery method according to a disclosed embodiment.

FIG. 2 is a schematic of an oil sands reservoir (200) at a depth of 200 to 500 m. Above the reservoir is a silty aquitard formation (202), an aquifer (204), and additional overburden (206). Aquifers are typically located at depths of between 50 and 150 m. An "aquifer" is an underground zone of water-bearing permeable rock or unconsolidated material (for example sand). An "aquitard" is an underground zone commonly found along an aquifer that restricts the flow of water therethrough. The aquitard offers inadequate flow restriction to non-condensable gases. In one embodiment, the hydrates form above, but close to, the reservoir, for example, in an aquitard.

In FIG. 2, a low pressure SAGD process is operating. Steam and the hydrate promoting additive are injected into the reservoir through an injection well (208) and viscous oil is produced through a production well (210). The arrows (212) illustrate the steam rising in the steam chamber (214), condensing (213) at the viscous oil/steam chamber interface, and returning to the production well (210). The gas mixture (215) at the top of the steam chamber comprises steam, methane, $CO_2$, $H_2S$, and the hydrate promoting additive. From this mixture, the non-condensable gases (214) rise out of the reservoir until they reach a region in the overlying formation where the thermodynamics favor formation of hydrates and a hydrate barrier (216) is formed by the non-condensable gases and water. Water (218) flows downward under a small potential gradient. The temperature profile is also illustrated (220), showing higher temperatures closer to the steam chamber.

If the process is operated at a pressure just below the aquifer pressure plus the hydrostatic gradient, then the potential difference between the aquifer and viscous oil reservoir will be such that water from the aquifer will tend to flow downward at a very slow rate. This will prevent or limit contamination of the aquifer by reservoir fluids such as water or oil. The hydrostatic gradient is $\rho g H_{at}$, where $\rho$ is the density of the aquitard (202), g is the gravitational constant, and $H_{at}$ is the height (222) of the aquitard as shown in FIG. 2. Thus, where $P_s$ is the operating pressure of the steam chamber, and $P_a$ is the aquifer pressure, the following relationship is satisfied:

$$P_s < P_a + \rho g H_{at}$$

In one embodiment, the following steps may be carried out:

1. Measure in the field or determine through laboratory tests the relative fractions of the different non-condensable gases that will be generated by the selected recovery process. For example, if the selected process is low pressure SAGD, then measurements can be made to estimate the amount of methane that will be released from the viscous oil at the recovery process pressures and temperatures. Similarly, measurements can be made to estimate the amounts of $CH_4$, $CO_2$ and $H_{25}$ that will be generated. Preliminary evaluation of methane release due to heating and steam injection can also be performed using equation of state models. Methane is a naturally occurring gas that is dissolved in bitumen at in situ reservoir conditions. The saturation of methane in bitumen as a function of reservoir pressure and temperature can be modeled using a popular tool called the Peng-Robinson equation-of-state (as described in Peng et al., A New Two-Constant Equation of State, Ind. Eng. Chem. Vol. 15, No. 1, p. 59-64, 1976). The generation of $CO_2$ and $H_2S$ is related to geothermal water-rock interaction and thermal degradation of bitumen. Equilibrium thermodynamic models can be used to estimate the relative quantity and distribution of various chemical species in a heated reservoir fluid system. An example of such a geothermal model can be found in Aggarwal et al.; SOLMNEQF: A computer code for geochemical modeling of water-rock interactions in sedimentary basins; Third Canadian/American Conference in Hydrogeology; 1986). There are existing data on $CO_2$ and $H_{25}$ generation autoclave experiments that can be used to tune these geochemical models.

2. Select quantities of light hydrocarbons (for example methane, ethane, or propane, or a mixture thereof, and optionally with $CO_2$) to be added to the steam or other injectant(s) of the recovery process such that the resulting non-condensable gas mixture at the top of the steam or solvent chamber mixture is prone to form hydrates within the temperature and operating pressure window in the overlying rock or overburden. In practice, one would likely select a non-condensable gas composition to add that would form hydrates itself at the target temperatures and pressures, and also form hydrates when mixed with a range of compositions of gases that are generated in the reservoir during the hydrocarbon recovery. Combination of equation of state and geochemical models as described above could be used to determine the composition of the gas mixture that would form at the top of the reservoir. Gas production data from related thermal recovery operations could also be used to establish the base composition upon which additional gases are needed to promote hydrate formation.

In another embodiment, the hydrate promoting additive is added separately from the injectant(s) used to reduce the viscosity of the viscous oil, either within the reservoir itself or above the reservoir, such that the desired hydrate formation conditions above the reservoir are achieved.

Certain embodiments of the instant invention may realize one or more of the following advantages. First, the formation of hydrates as shown in FIG. 2 is not particularly sensitive to the gas compositional mixture; and as a result, the process can be expected to be relatively robust. Second, the addition of ethane or propane to a process such as low pressure SAGD will also have generally positive impacts on the recovery process since the gases will also tend to dissolve into the viscous oil and aid in reducing its viscosity. The gases may also be selected based on their compatibility with the metallurgical properties of the subsurface tubulars and equipment in the operating wells.

Using the hydrate formation envelopes in FIG. 1 as reference, gas additives required to maintain the desired composition can be administered as a percentage of the evolved gases. A field gas sampling program can be used to monitor the required gas composition and make necessary adjustments. Installing temperature sensor(s) in the hydrate barrier interval, along with sampled gas composition can provide the data to maintain the integrity of the hydrate barrier.

In the preceding description, for purposes of explanation, numerous details are set forth in order to provide a thorough understanding of the embodiments of the invention. However, it will be apparent to one skilled in the art that these specific details are not required in order to practice the invention.

Embodiments of the invention can be represented as a software product stored in a machine-readable medium (also referred to as a computer-readable medium, a processor-readable medium, or a computer usable medium having a computer-readable program code embodied therein). The machine-readable medium can be any suitable tangible medium, including magnetic, optical, or electrical storage medium including a diskette, compact disk read only memory (CD-ROM), memory device (volatile or non-volatile), or similar storage mechanisms. The machine-readable medium can contain various sets of instructions, code sequences, configuration information, or other data, which, when executed, cause a processor to perform steps in a method according to an embodiment of the invention. Those of ordinary skill in the art will appreciate that other instructions and operations necessary to implement the described invention can also be stored on the machine-readable medium. Software running from the machine-readable medium can interface with circuitry to perform the described tasks.

The above-described embodiments of the invention are intended to be examples only. Alterations, modifications and variations can be effected to the particular embodiments by those of skill in the art without departing from the scope of the invention, which is defined solely by the claims appended hereto.

REFERENCES

The following references relate to sensing, estimating, or monitoring conditions including hydrate formation during hydrocarbon production: Canadian Patent No. 2,293,686 to Johnson et al.; Canadian Patent No. 2,288,784 to Tubel et al.; United States Patent Publication Nos. 2008/0257544 and 2008/0262737, both to Thigpen et al.; and United States Patent Publication No. 2008/0221799 to Murray.

The following references relate to hydrate promotion: Canadian Patent No. 2,038,290 to Puri et al., which discusses the advantages of gas hydrate formation from coal seams to promote methane recovery; United States Patent Publication No. 2009/0032248 to Svoboda et al., which relates to a process for gas hydrate production and in situ use thereof; and U.S. Pat. No. 6,028,234 to Heinemann et al., which relates to processes for making gas hydrates in various industrial processes including the storage and transportation of natural gas.

Canadian laid open Patent Application No. 2,672,487 to Larter et al. describes techniques for preconditioning an oil field reservoir including promoting hydrate formation within the reservoir by a pre-conditioning agent such as methane, ethane, propane, normal butane, isobutene, and carbon dioxide. The hydrates are formed and then broken to assist oil recovery.

U.S. Pat. No. 3,559,737 to Ralstin et al. describes sealing fractures in caprocks of fluid storage reservoirs to establish flow barriers at desired regions of porous rocks by locally freezing the formation water to form an impervious cryogenic structure and/or by forming gas hydrates.

U.K. Patent No. 2,377,718 to Vienot describes injecting a hydrate forming hydrocarbon gas during a water flood operation, after the water drive, with water to form hydrates to restrict flow. The hydrate forming hydrocarbon gas is injected into the highly permeable fluid flow path and the hydrocarbon gas reacts with the water remaining in the highly permeable flow path to form a solid gas hydrate which restricts flow in the highly permeable fluid flow path.

What is claimed is:

1. A method of forming a hydrate barrier during in situ hydrocarbon production above a reservoir of the hydrocarbons, the method comprising:

selecting a hydrate promoting additive; and introducing the hydrate promoting additive into, or above, the reservoir for mixing with generated non-condensable gases, to promote hydrate formation in an area above the reservoir, for forming the hydrate barrier in the area, for limiting passage of non-condensable gases through the area, wherein the hydrate barrier comprises hydrates comprising water and non-condensable gases, and wherein the hydrate promoting additive is co-injected with steam, the steam being for reducing a viscosity of the hydrocarbons.

2. The method of claim 1 wherein the hydrocarbons are a viscous oil having a viscosity of at least 10 cP at initial reservoir conditions.

3. The method of claim 1 wherein the hydrate promoting additive is introduced into the reservoir.

4. The method of claim 1 wherein the hydrate promoting additive is selected from the group consisting of methane, ethane, propane, or a combination thereof.

5. The method of claim 1 wherein the hydrate promoting additive is selected from the group consisting of ethane, propane, or a combination thereof.

6. The method of claim 1 wherein the in situ hydrocarbon production is by injection of a viscosity reducing solvent and production of the viscosity reducing solvent and the hydrocarbons.

7. The method of claim 1 wherein the in situ hydrocarbon production is by SA-SAGD.

8. The method of claim 1 wherein the in situ hydrocarbon production is by SAGD.

9. The method of claim 1 wherein the in situ hydrocarbon production is by VAPEX.

10. The method of claim 1 wherein the hydrate promoting additive is co-injected with a viscosity reducing solvent, the viscosity reducing solvent being for reducing the viscosity of the hydrocarbons.

11. The method of claim 1 wherein the non-condensable gases comprise hydrocarbon vapour.

12. The method of claim 1 wherein the hydrate barrier comprises hydrates and naturally occurring consolidated or unconsolidated material.

13. The method of claim 1 wherein the hydrate promoting additive is configured to form hydrates with water.

14. The method of claim 1 wherein the reservoir is a reservoir lacking an adequate top barrier to contain non-condensable gases.

15. The method of claim 1 wherein the reservoir is at a depth of between 100 m and 250 m.

16. The method of claim 1 wherein a sufficient amount of the hydrate promoting additive is introduced into, or above, the reservoir to allow hydrate formation in the area above the reservoir in which the hydrate barrier forms at between 4° C. and 12° C.

17. The method of claim 1 wherein an area above the reservoir in which the hydrate barrier forms is an aquitard.

18. A method of forming a hydrate barrier during in situ hydrocarbon production above a reservoir of the hydrocarbons, the method comprising:

selecting a hydrate promoting additive; and introducing the hydrate promoting additive into, or above, the reservoir for mixing with generated non-condensable gases, to promote hydrate formation in an area above the reservoir, for forming the hydrate barrier in the area, for limiting passage of non-condensable gases through the area, wherein the hydrate barrier comprises hydrates comprising water and non-condensable gases, wherein the hydrate promoting additive is co-injected with a viscosity reducing solvent, the viscosity reducing solvent being for reducing the viscosity of the hydrocarbons, and wherein the viscosity reducing solvent comprises a $C_{5+}$gas condensate comprising pentane and hexane.

19. A method of forming a hydrate barrier during in situ hydrocarbon production above a reservoir of the hydrocarbons, the method comprising:

selecting a hydrate promoting additive;

introducing the hydrate promoting additive into, or above, the reservoir for mixing with generated non-condensable gases, to promote hydrate formation in an area above the reservoir, for forming the hydrate barrier in the area, for limiting passage of non-condensable gases through the area, wherein the hydrate barrier comprises hydrates comprising water and non-condensable gases;

prior to injecting the hydrate promoting additive, estimating relative fractions of the non-condensable gases that will be generated during the in situ hydrocarbon production selected; and using the estimated relative fractions to select the hydrate promoting additive.

* * * * *